US012520927B1

(12) United States Patent
Ghani

(10) Patent No.: US 12,520,927 B1
(45) Date of Patent: Jan. 13, 2026

(54) PERSONAL CARE PRODUCT DISPENSER WITH DIPSTICK AND ROLL-ON APPLICATORS

(71) Applicant: Umbrella Scents US LLC, Austin, TX (US)

(72) Inventor: Abdulaziz Mohammad Ghani, Austin, TX (US)

(73) Assignee: Umbrella Scents US LLC, Austin, TX (US)

( * ) Notice: Subject to any disclaimer, the term of this patent is extended or adjusted under 35 U.S.C. 154(b) by 0 days.

(21) Appl. No.: 18/988,812

(22) Filed: Dec. 19, 2024

Related U.S. Application Data

(60) Provisional application No. 63/720,692, filed on Nov. 14, 2024.

(51) Int. Cl.

| | |
|---|---|
| ***A45D 34/04*** | (2006.01) |
| ***A45D 34/06*** | (2006.01) |
| ***A45D 40/18*** | (2006.01) |
| ***A45D 40/24*** | (2006.01) |
| ***A45D 40/26*** | (2006.01) |
| *B65D 51/18* | (2006.01) |

(52) U.S. Cl.
CPC ..... *A45D 34/041* (2013.01); *A45D 34/045* (2013.01); *A45D 34/06* (2013.01); *A45D 40/18* (2013.01); *A45D 40/24* (2013.01); *A45D 40/26* (2013.01); *B65D 51/18* (2013.01)

(58) Field of Classification Search
CPC .... A45D 34/041; A45D 34/045; A45D 34/06; A45D 40/18; A45D 40/24; A45D 40/26; B65D 51/18
USPC ..... 401/17, 21, 37
See application file for complete search history.

(56) References Cited

U.S. PATENT DOCUMENTS

| | | | | |
|---|---|---|---|---|
| 6,059,474 | A * | 5/2000 | Huang | B65D 51/32 401/36 |
| 6,776,548 | B2 * | 8/2004 | Gardner, Jr. | A45C 5/02 401/38 |
| 2019/0142135 | A1 | 5/2019 | Murphy et al. | |

(Continued)

FOREIGN PATENT DOCUMENTS

| | | | |
|---|---|---|---|
| FR | 2812799 | A1 | 2/2002 |
| KR | 102511951 | B1 | 3/2023 |
| WO | 148397 | A1 | 10/2015 |

(Continued)

*Primary Examiner* — Jennifer C Chiang
(74) *Attorney, Agent, or Firm* — FRESH IP PLC; Michael Anderson

(57) ABSTRACT

Disclosed herein is a packaging system for dispensing a personal care product such as a perfume. The packaging system has dual dispensing option of a dipstick and a roll-on dispenser in a single unit. The packaging system includes a reservoir, a lower cap, and an upper cap. The lower cap has a dipstick that is wetted in the reservoir. The lower cap can be unscrewed from the reservoir to expose the dipstick for use in dabbing a personal care product on skin. The lower cap also has a spherical ball that is exposed when the upper cap is unscrewed from the lower cap while the lower cap remains engaged with the reservoir section. When the packaging system is turned on its side or upside down, the liquid personal care product wets the spherical ball, and the ball can be used for roll-on application of the personal care product.

8 Claims, 4 Drawing Sheets

(56) References Cited

U.S. PATENT DOCUMENTS

| | | | |
|---|---|---|---|
| 2020/0156823 | A1 | 5/2020 | Hon et al. |
| 2022/0248827 | A1 | 8/2022 | Holtzman et al. |

FOREIGN PATENT DOCUMENTS

| | | | |
|---|---|---|---|
| WO | 091419 | A1 | 6/2017 |
| WO | 091420 | A1 | 6/2017 |
| WO | 091421 | A1 | 6/2017 |
| WO | 091126 | A1 | 5/2020 |
| WO | 199118 | A1 | 10/2023 |

* cited by examiner

PERSONAL CARE PRODUCT DISPENSER WITH DIPSTICK AND ROLL-ON APPLICATORS

FIELD OF THE INVENTION

This invention pertains to a dispenser for a personal care product such as a perfume. The dispenser has dual dispensing option of a dipstick and a roll-on dispenser in a single unit.

BACKGROUND

Several methods exist to dispense and apply liquid personal care products such as perfumes or liquid fragrances to the skin of a person. Spray bottles that generate a mist are a common method.

Other methods include a dipstick that sits in a reservoir of a liquid and can be withdrawn to apply a liquid to the skin, for example as shown at https://www.etsy.com/listing/1494583957/3 ml-glass-dipstick-with-plastic-knob-for (checked Dec. 7, 2024). This may be a better solution to a spray for more viscous products such as perfume oils. Yet another method for applying a liquid such as perfume to the skin is a roll-on using a spherical ball, for example as shown in WO2020/091126 A1 or https://www.amazon.com/Furnido-Refillable-Stainless-Essential-cosmetics/dp/B077ZVDWM6/(checked Dec. 7, 2024).

SUMMARY OF THE INVENTION

While the use of dipstick-type perfume applicators and roll-on-type perfume applicators is well known, no one has previously combined both types of applicators into a simple device.

Accordingly, in an embodiment, a device is provided for dispensing a personal care liquid composition to the skin of a person. The device is an apparatus having a lower body comprising a reservoir holding a liquid personal care composition, wherein the lower body has a neck with lower body male screw threads. The device may have a nested cap assembly comprising an upper cap and a lower cap. The device may have a lower cap having a base section having lower cap female threads that engage with the lower body male threads to form an enclosure protecting the liquid personal care composition. A dipstick may be seated axially in the base section of the lower cap and pointing downward into the reservoir when the lower cap is in a resting position threaded onto the lower body male screw threads. The lower cap may have an upper section including a neck having lower cap male threads and a spherical ball pointing upward that may be seated in the neck of the lower cap. The spherical ball can be wetted by the liquid personal care composition when the device is turned upside down or on its side. The upper cap may have upper cap female threads that interact with the lower cap male threads, so that the upper cap shields the spherical ball when the upper cap is screwed into position.

In an embodiment, the personal care liquid composition is a perfume.

In an embodiment, the personal care liquid composition can be applied to the skin by dabbing the skin with the dipstick or by rolling on the skin with spherical ball.

In an embodiment, a gasket is present in the lower cap that forms a liquid seal with a lip of the neck of the lower body. In an embodiment, the gasket comprises natural or synthetic rubber, silicone, neoprene, or a plastic polymer.

In an embodiment, the spherical ball is made from glass, ceramic, a hard plastic, or stainless steel.

In an embodiment, a method of applying a personal care liquid composition to the skin of a person is provided. The liquid composition is stored in a device (also termed an apparatus) having a lower body comprising a reservoir holding a liquid personal care composition, wherein the lower body may have a neck with lower body male screw threads. The device may include a nested cap assembly comprising an upper cap and a lower cap, wherein the lower cap has a base section having lower cap female threads that engage with the lower body male threads to form an enclosure protecting the liquid personal care composition. A dipstick may be seated axially in the base section of the lower cap and pointing downward into the reservoir when the lower cap is threaded onto the lower body male screw threads while the device is in an upright resting position. The lower cap may have an upper section comprising a neck having lower cap male threads, and wherein a spherical ball pointing upward is seated in the neck of the lower cap, and the ball can be wetted by the liquid personal care composition when the device is turned on its side or upside down. The upper cap may have upper cap female threads that interact with the lower cap male threads, and wherein the upper cap shields the spherical ball when the upper cap is screwed into position, i.e., when the upper cap female threads are fully engaged with the lower cap male threads. In the method, the lower cap has a first sealed position wherein the lower cap female threads of the base section are engaged with the lower body male threads, and the lower cap has a first open position wherein the base section of the lower cap is unscrewed and withdrawn from the lower body to expose the wetted dipstick for use in dabbing the liquid personal care composition on the skin of the person. Alternatively, the upper cap has a second sealed position wherein the upper cap female threads are engaged with the lower cap male threads and the lower cap is in the first sealed position, and wherein the upper cap has a second unsealed position when the upper cap is unscrewed from the lower cap male threads while the lower cap remains in the first sealed position, thereby exposing the spherical ball for use when the device is turned upside down or on its side to allow the liquid personal care composition to wet the spherical ball, and the liquid personal care composition can be rolled on to the skin of the person. In this fashion, the user selects the use of the dipstick or the spherical ball to apply the liquid personal care composition to the skin, and both options are provided for in the same packaging system.

In an embodiment of the method, a user such as a person selects the use of the dipstick or the spherical ball to apply the liquid personal care composition to the skin, and both options are provided for in the same packaging system. The selection is accomplished by unscrewing either the lower cap to expose the dipstick for use, or leaving the lower cap engaged with the base and unscrewing the upper cap from the lower cap to expose the spherical ball for use.

DETAILED DESCRIPTION

Figure 1:
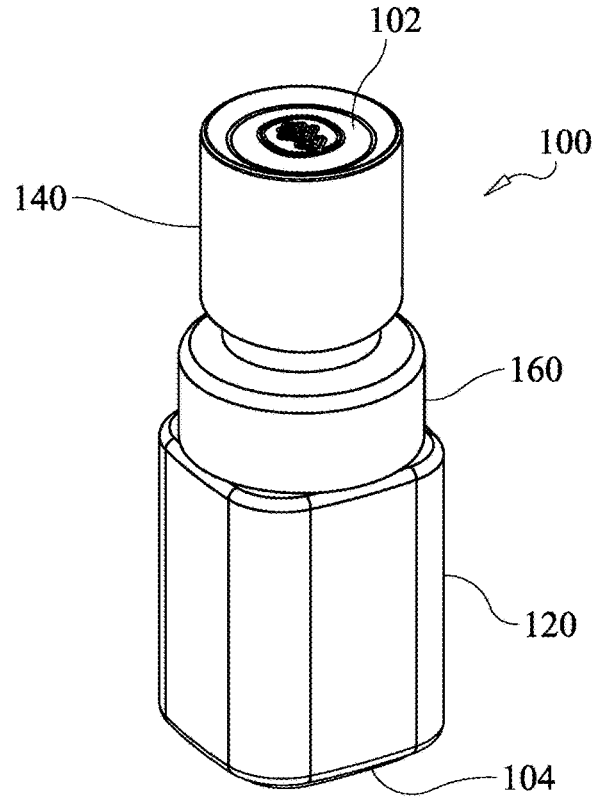
FIG. 1 is a perspective view of the complete packaging system for dispensing a personal care liquid composition to the skin of a person.

Referring to FIGS. 1-6, this invention provides a device 100 for dispensing a personal care liquid composition 110 to the skin of a person. Because this device (also termed a "packaging system" or an "apparatus") is designed to hold a liquid composition, it has a top 102 and a bottom 104. In an embodiment, the packaging system 100 sits (rests) on a flat surface. Normally, bottom 104 would be in contact with a flat surface such as a tabletop. References are made herein to a "resting position" which means that the device 100 is fully engaged as shown in FIG. 1 and is resting upright on a flat surface such as a tabletop.

The device may have a lower body 120 having fect 122 and comprising a reservoir 124 that stores and holds a liquid personal care composition 110, wherein the lower body may have a neck 126 with lower body male screw threads 128. The device may have a nested cap assembly 130 (FIG. 5) comprising an upper cap 140 and a lower cap 160, wherein the lower cap may have a base section 162 that may include lower cap female threads 164 that interact with and engage the lower body male threads 128 to form an enclosure protecting the liquid personal care composition. The lower cap 160 may have an upper section 166 comprising a neck 168 having lower cap male threads 170. A dipstick 172 may be seated axially in the base section of the lower cap 160 and pointing downward into the reservoir (when device 100 is resting on a surface) when the lower cap is threaded onto the lower body male screw thread. Brackets 182 hold the dipstick in position. The neck of the lower cap may further include a spherical ball 174 pointing upward when the packaging system is in a resting position sitting on a surface. Brackets 180, which are integral with lower cap 160, support the ball and keep it firmly in position. The upper cap 140 may have upper cap female threads 142 that interact and engage with the lower cap male threads 170, and the upper cap may 140 shield and enclose the spherical ball 174 when the upper cap is screwed into position.

Figure 2:
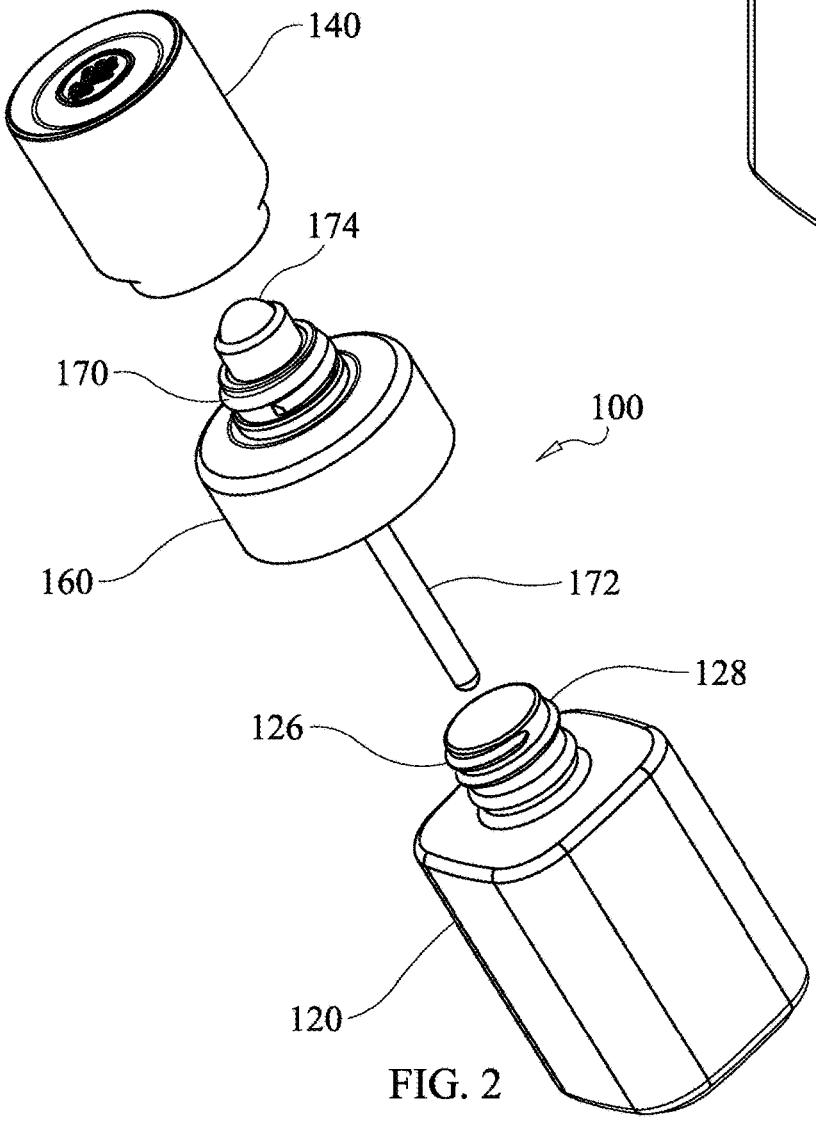
FIG. 2 is an exploded view of the three sections of the packaging system for dispensing a personal care liquid composition showing the three sections disassembled and showing how the three sections fit together.
Figure 3A:
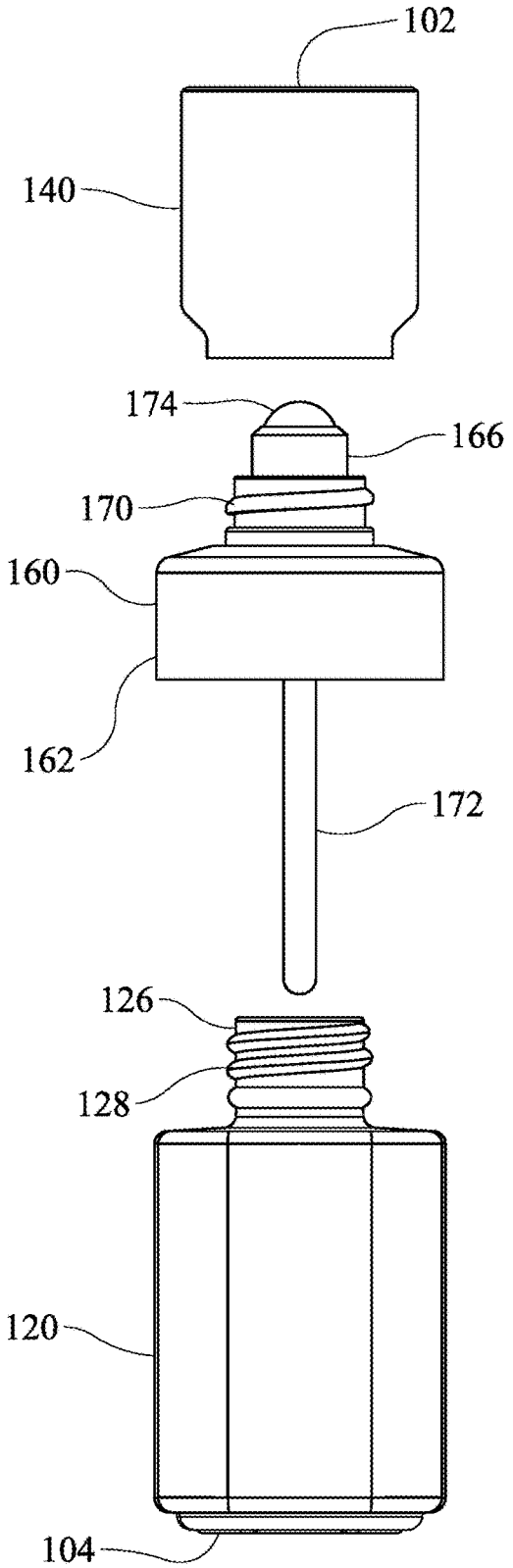
FIG. 3A is an exterior elevation view of the three sections of the packaging system for dispensing a personal care liquid composition.
Figure 3B:
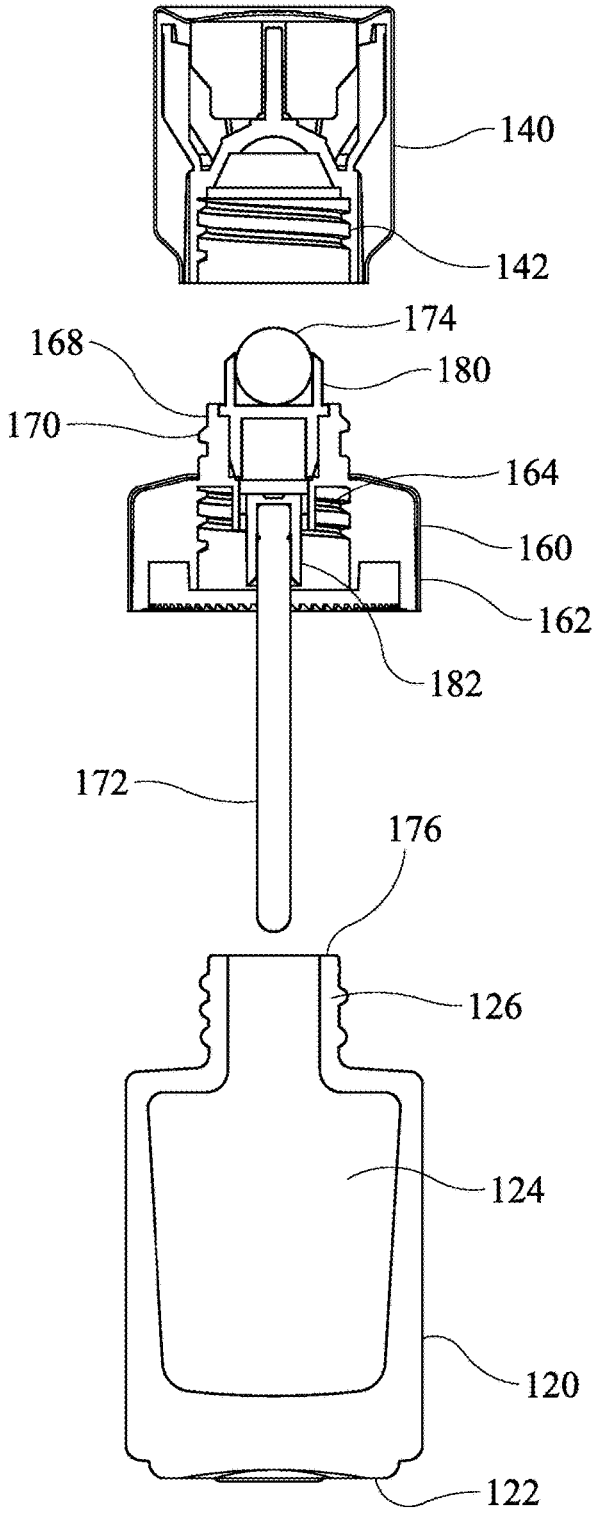
FIG. 3B is a cross-sectional view of the three sections of the packaging system for dispensing a personal care liquid composition showing internal structures in the packaging system.
Figure 4:
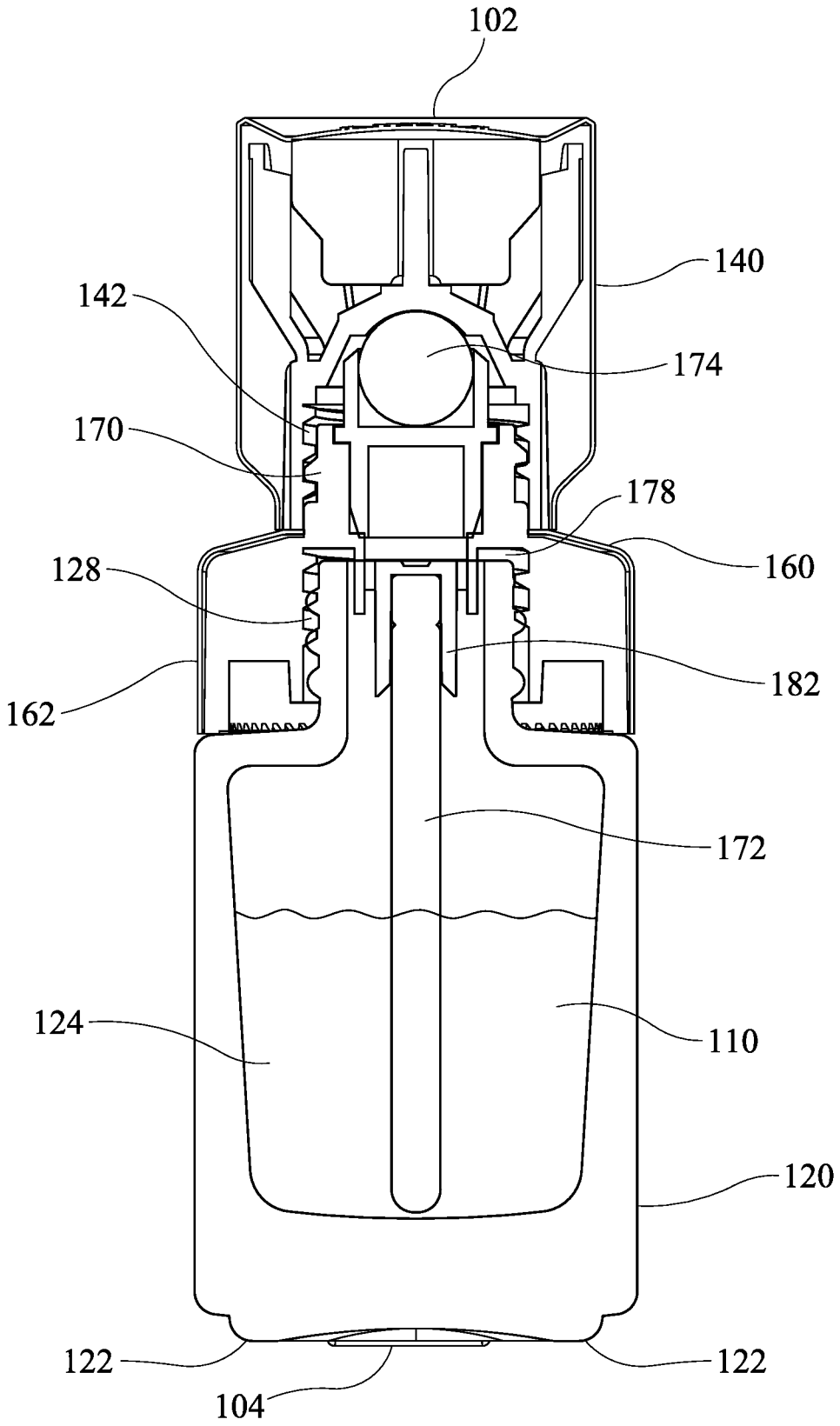
FIG. 4 is a cross-sectional view of the complete packaging system assembled.

The inventive packaging system device has three sections: a base section 120, a lower cap 140, and an upper cap 160. The interplay of these three sections is shown in FIGS. 2, 3A, and 3B. FIG. 2 is a perspective exploded view of the three sections of the packaging system for dispensing a personal care liquid composition showing the three sections disassembled and showing how the three sections fit together. FIG. 3A is an exterior elevation view of the three sections of the packaging system. FIG. 3B is a cross-sectional view of the three sections of the packaging system. A fully assembled cross-sectional view is in FIG. 4. FIG. 4 is a cross-sectional view of the same configuration as FIG. 1, with all three sections fully engaged. This may also be termed a "resting position".

The personal care liquid composition used in the packaging system may be a perfume. The liquid composition may be a low viscosity liquid for example with an aqueous or alcohol base, or the composition may be relatively viscous, like an oil.

Figure 5:
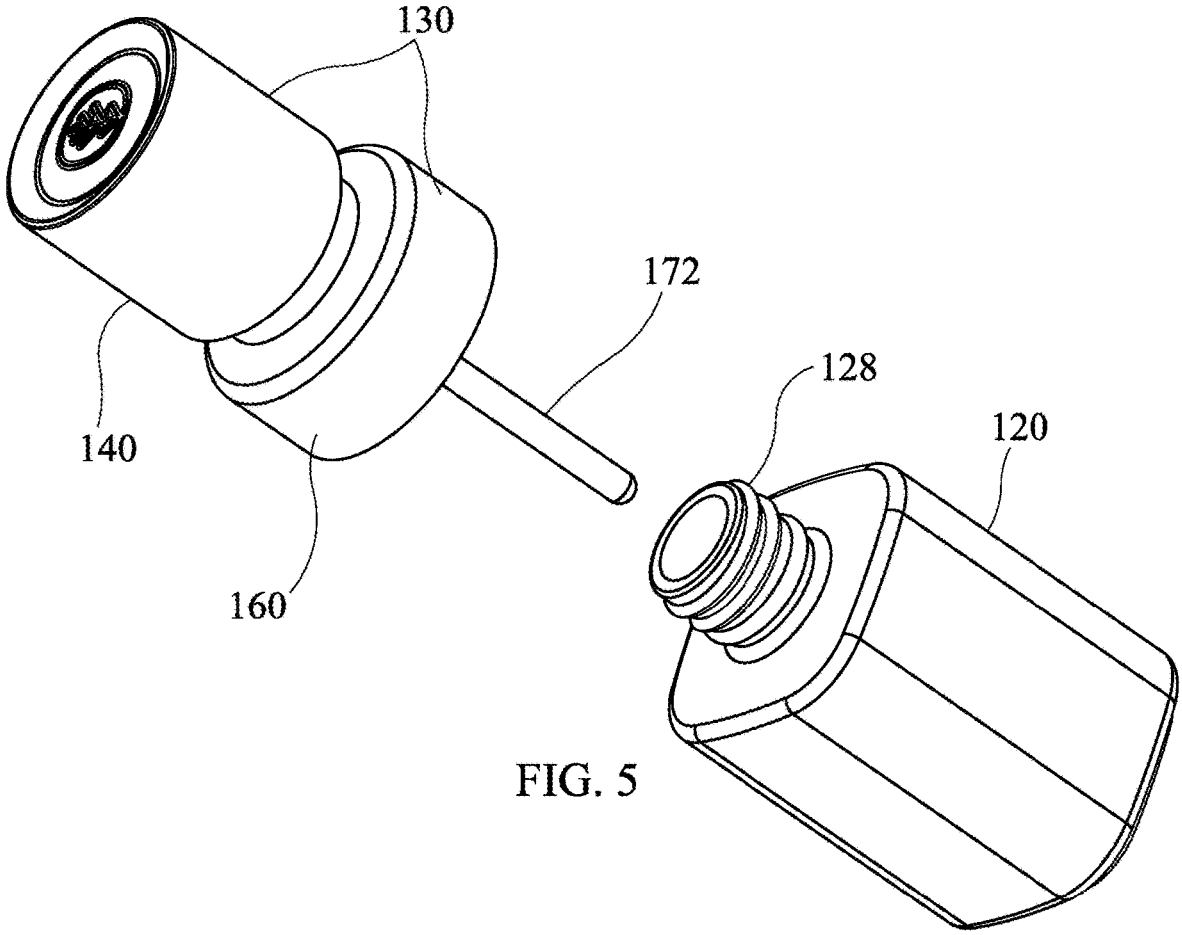
FIG. 5 shows the packaging system with the dipstick exposed for use.

The personal care liquid composition in the packaging system may be applied to the skin by dabbing the skin with the dipstick or by rolling on the skin with spherical ball, depending on how the inventive device is used as discussed below. In a first embodiment as shown in FIG. 5, the packaging system is configured for use with the dipstick to dab a personal care liquid composition on the skin of a person. In this embodiment, starting from the fully assembled device 100 (FIG. 1), the nested upper and lower caps 130 are unscrewed from lower body 140 which exposes the dipstick that is wetted from the personal care liquid composition in reservoir 124. This configuration is shown in FIG. 5. This is termed herein a "first opened position." When the lower cap is screwed into the lower body and fully engaged with the lower body, that is termed a "first sealed position." When the system is in the first open position as shown in FIG. 5, the wetted dipstick is exposed for use and can be touched to the skin of a person to apply the personal care liquid composition by dabbing or smearing it on the skin.

Figure 6:
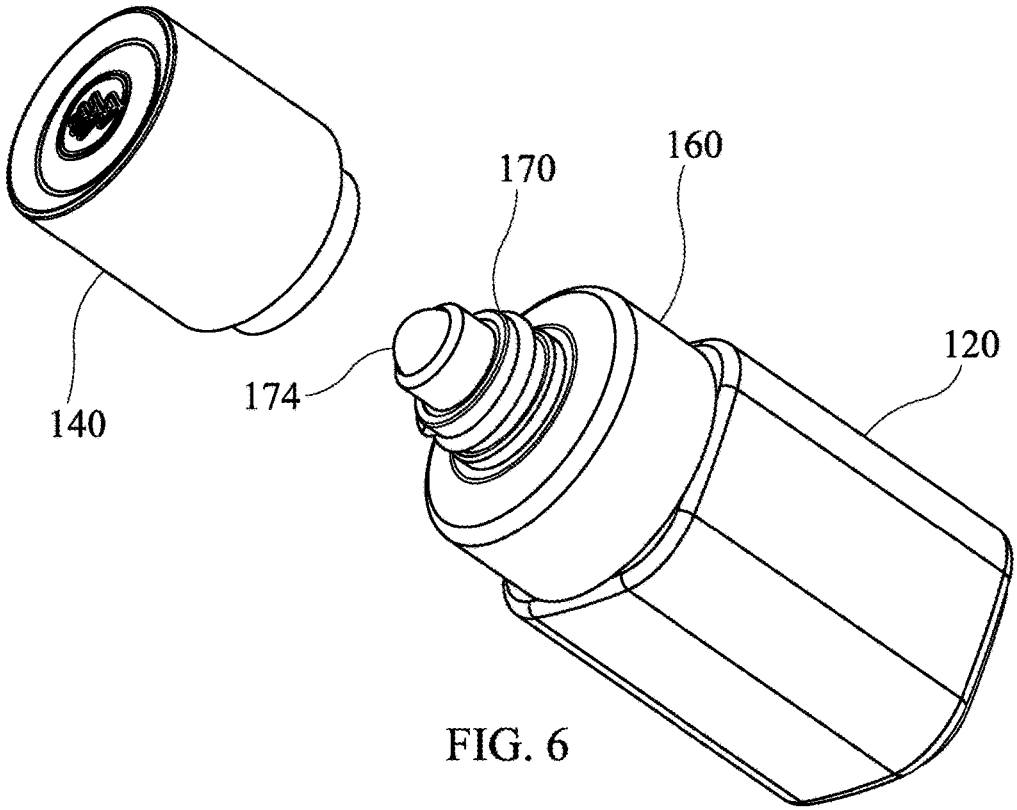
FIG. 6 shows the packaging system with the ball exposed for use.

Alternatively, in a second embodiment, the personal care liquid composition may be applied to the skin of a person as a roll-on by unscrewing upper cap 140 from lower cap 160, while lower cap 160 is engaged with lower body 120, as shown in FIG. 6. This is termed a "second open position." The "second sealed position" exists when the upper cap female threads 142 are engaged with the lower cap male threads 170 and the lower cap is in the first sealed position. When the device is in the second open position, and the device is turned on its side or upside down in this position, passageways are provided in the lower cap allowing the liquid composition to moisten (i.e., wet) the spherical ball 174, allowing the personal care liquid composition 110 to be applied to the skin by rolling it on.

Thus, by unscrewing the lower cap 160 from lower body 120 (the first open position), the dipstick may be used. By leaving the lower cap engaged with the lower body (in the first sealed position) and unscrewing the upper cap 140 from the lower cap 160 (the second open position), the roll-on spherical ball is used. In this fashion, both application methods are provided for in a single, convenient to use device.

In an embodiment, a gasket 178 is present in the lower cap that forms a liquid seal with a lip 176 of the neck 126 of the lower body. The gasket may be fabricated from natural or synthetic rubber, silicone, neoprene, or a plastic polymer.

The spherical ball 174 may be made from glass, ceramic, a hard plastic, or stainless steel.

The lower body 120 may be fabricated from glass, ceramic, a hard plastic, or a metal such as steel, aluminum, or titanium or an alloy thereof. The lower cap base section 162 may be fabricated from a hard plastic, glass, ceramic, or a metal such as steel, aluminum, or titanium or an alloy thereof. The upper cap may be fabricated from a hard plastic, glass, ceramic, or a metal such as steel, aluminum, or titanium or an alloy thereof.

In an embodiment for use as a personal care packaging system, the system is approximately 95 mm tall and 34 mm wide, but these dimensions are not critical. Another optional feature of this system is that it has a certain amount of heft, which may give the system a more luxurious feel.

Drawing Legend

| No. | Description |
|---|---|
| 100 | Device for dispensing a personal care liquid composition. Also termed a packaging system |
| 102 | Top of packaging system |
| 104 | Bottom of packaging system |
| 110 | personal care liquid composition |
| 120 | Lower body |
| 122 | Feet on lower body |
| 124 | Reservoir part of lower body |
| 126 | Neck on lower body |
| 128 | Lower body male screw threads |
| 130 | nested cap assembly |
| 140 | upper cap |
| 142 | upper cap female threads |
| 160 | Lower cap |
| 162 | Lower cap base section |
| 164 | lower cap female threads |
| 166 | Lower cap upper section |
| 168 | neck of the lower cap upper section |
| 170 | lower cap male threads on the neck of the lower cap upper section |
| 172 | dipstick |
| 174 | Spherical ball |
| 176 | Lip on lower body neck |
| 178 | Gasket in lower cap |
| 180 | Brackets holding spherical ball |
| 182 | Bracket holding dipstick |

The invention claimed is:

1. A device for dispensing a personal care liquid composition to the skin of a person, comprising:

a. an apparatus having a lower body comprising a reservoir holding a liquid personal care composition, wherein the lower body has a neck with lower body male screw threads;

b. a nested cap assembly comprising an upper cap and a lower cap;

c. wherein the lower cap has a base section having lower cap female threads that engage with the lower body male threads to form an enclosure protecting the liquid personal care composition;

d. wherein a dipstick is seated axially in the base section of the lower cap and pointing downward into the reservoir when the lower cap is threaded onto the lower body male screw threads;

e. wherein the lower cap has an upper section comprising a neck having lower cap male threads, and wherein a spherical ball pointing upward is seated in the neck of the lower cap, and the ball can be wetted by the liquid personal care composition when the device is turned upside down or on its side; and f. wherein the upper cap has upper cap female threads that interact with the lower cap male threads, and wherein the upper cap shields the spherical ball when the upper cap is screwed into position.

2. The device of claim 1 wherein the personal care liquid composition is a perfume.

3. The device of claim 1 wherein the personal care liquid composition can be applied to the skin by dabbing the skin with the dipstick or by rolling on the skin with spherical ball.

4. The device of claim 1 wherein a gasket is present in the lower cap that forms a liquid seal with a lip of the neck of the lower body.

5. The gasket of claim 4 wherein the gasket comprises natural or synthetic rubber, silicone, neoprene, or a plastic polymer.

6. The device of claim 1 wherein the spherical ball is made from glass, ceramic, a hard plastic, or stainless steel.

7. A method of applying a personal care liquid composition to the skin of a person, wherein the personal care liquid composition is stored in a device, comprising:

a. an apparatus having a lower body comprising a reservoir holding a liquid personal care composition, wherein the lower body has a neck with lower body male screw threads;

b. a nested cap assembly comprising an upper cap and a lower cap;

c. wherein the lower cap has a base section having lower cap female threads that engage with the lower body male threads to form an enclosure protecting the liquid personal care composition;

d. wherein a dipstick is seated axially in the base section of the lower cap and pointing downward into the reservoir when the lower cap is threaded onto the lower body male screw threads;

e. wherein the lower cap has an upper section comprising a neck having lower cap male threads, and wherein a spherical ball pointing upward is seated in the neck of the lower cap, and the ball can be wetted by the liquid personal care composition when the device is turned upside down or on its side;

f. wherein the upper cap has upper cap female threads that interact with the lower cap male threads, and wherein the upper cap shields the spherical ball when the upper cap is screwed into position;

g. wherein the lower cap has a first sealed position wherein the lower cap female threads of the base section are engaged with the lower body male threads, and the lower cap has a first open position wherein the base section of the lower cap is unscrewed and withdrawn from the lower body to expose the wetted dipstick for use in dabbing the liquid personal care composition on the skin of the person;

h. wherein the upper cap has a second sealed position wherein the upper cap female threads are engaged with the lower cap male threads and the lower cap is in the first sealed position, and wherein the upper cap has a second unsealed position when the upper cap is unscrewed from the lower cap male threads while the lower cap remains in the first sealed position, thereby exposing the spherical ball for use when the device is turned upside down or on its side to allow the liquid personal care composition to wet the spherical ball, and the liquid personal care composition can be rolled on to the skin of the person.

8. The method of claim 7 wherein the person selects the use of the dipstick or the spherical ball to apply the liquid personal care composition to the skin, and both options are provided for in the same packaging system.

* * * * *